US008448650B2

(12) United States Patent
Higgins

(10) Patent No.: US 8,448,650 B2
(45) Date of Patent: May 28, 2013

(54) COSMETIC APPLICATOR

(75) Inventor: Eileen A. Higgins, Secaucus, NJ (US)

(73) Assignee: Avon Products, Inc., New York, NY (US)

( * ) Notice: Subject to any disclaimer, the term of this patent is extended or adjusted under 35 U.S.C. 154(b) by 0 days.

(21) Appl. No.: 13/283,927

(22) Filed: Oct. 28, 2011

(65) Prior Publication Data

US 2013/0104924 A1 May 2, 2013

(51) Int. Cl.
*A45D 40/26* (2006.01)

(52) U.S. Cl.
USPC ..... 132/218; 15/187; 15/DIG. 5

(58) Field of Classification Search
USPC ..... 132/218, 317, 320; 15/186–188, 15/160, DIG. 5
See application file for complete search history.

(56) References Cited

U.S. PATENT DOCUMENTS

| | | | | |
|---|---|---|---|---|
| 2008/0142034 | A1* | 6/2008 | Manici et al. | 132/218 |
| 2011/0030718 | A1* | 2/2011 | Gueret | 132/218 |
| 2011/0067725 | A1* | 3/2011 | Manici | 132/218 |
| 2011/0297173 | A1* | 12/2011 | Anderson et al. | 132/218 |

* cited by examiner

*Primary Examiner* — Rachel Steitz
(74) *Attorney, Agent, or Firm* — Charles S. Zeller; David M. Joyal; Joan M. McGillycuddy

(57) ABSTRACT

An applicator is provided for applying a composition to a user's eyelashes. The applicator includes an applicator element having a large section, a medium section, and a small section, which are adapted to cover the outer, middle, and inner portions of a user's eyelashes, respectively, with a composition (e.g., mascara). The three sections of the applicator element include bristles sized and spaced in such a way as to facilitate even application of the composition without clumping.

16 Claims, 3 Drawing Sheets

100
110
180
103
102
110
180
110
100

COSMETIC APPLICATOR

FIELD OF INVENTION

The present invention relates generally to applicators for cosmetics. More particularly, the present invention relates to applicators for applying a cosmetic composition to eyelashes.

BACKGROUND OF THE INVENTION

The general purpose of a mascara applicator or brush is to pick up an adequate supply of mascara from a container, carry it from a reservoir of the container without dripping, and apply it evenly to the eyelashes. The applicator must accomplish this without depositing lumps or blobs of the material on the eyelashes.

Conventional mascara applicators generally include a brush having a twisted wire core and a bristle portion. The bristle portion generally includes a number of uniformly sized bristles spaced evenly throughout its length. Although these applicators are generally capable of depositing mascara onto the eyelashes, they do not facilitate application of the product to all eyelashes in an accurate or detailed manner, particularly the inner, middle, and outer portions of the eyelashes. Therefore, a user must carry a variety of applicators or must manipulate the brush in an unnatural direction to cover the eyelashes.

It is thus desirable to provide a single cosmetic applicator having multiple sections capable of evenly covering the inner, middle, and outer eyelashes of a user in a single stroke.

SUMMARY OF THE INVENTION

In accordance with the foregoing objectives and others, the present invention provides an applicator for applying a composition to a user's eyelashes. The applicator includes an applicator element having a large section, a medium section, and a small section, which are adapted to cover the outer, middle, and inner portions of a user's eyelashes, respectively, with a composition (e.g., mascara). The three sections of the applicator element include bristles sized and spaced in such a way as to facilitate even application of the composition without clumping.

In one aspect of the invention, an applicator for applying a product to the eyelashes is provided. The applicator includes a handle, which is attached directly or indirectly to the proximal end of an applicator element. Typically, the applicator element has a generally elongated body which includes, in series, from the proximal end to its distal end, a first section, a second section, and a third section. The three sections each include a plurality of bristles extending radially from the body. The spacing between adjacent bristles is typically largest in the first section and smallest in the third section.

In one embodiment, the longest bristles in each of the three sections of the applicator element may differ in length from the longest bristles in each other section. For example, the largest bristle in the first section may be larger than the largest bristle in the second section, which may be larger than the largest bristle in the third section. Moreover, the lengths of the bristles within each section may vary to give a generally ovoid or spherical appearance to each section.

These and other aspects of the invention will become apparent to those skilled in the art after a reading of the following detailed description of the invention, including the figures and appended claims.

BRIEF DESCRIPTION OF THE FIGURES

The preferred embodiments of the present invention are illustrated by way of example and are not limited to the following figures.

DETAILED DESCRIPTION

All terms used herein are intended to have their ordinary meaning in the art unless otherwise provided.

The applicator elements described herein are suitable for applying a composition, such as a cosmetic composition, to eyelashes and may also be suitable for imparting a grooming effect to further improve the aesthetic appearance of the eyelashes. In particular, the applicator element according to the invention is useful for application of an eyelash composition to the eyelashes, including without limitation, pigmented and unpigmented mascaras, pharmaceutically and/or cosmeceutically active eyelash compositions, one or more parts of a multi-component mascara formulation, or a combination thereof.

Figure 1:
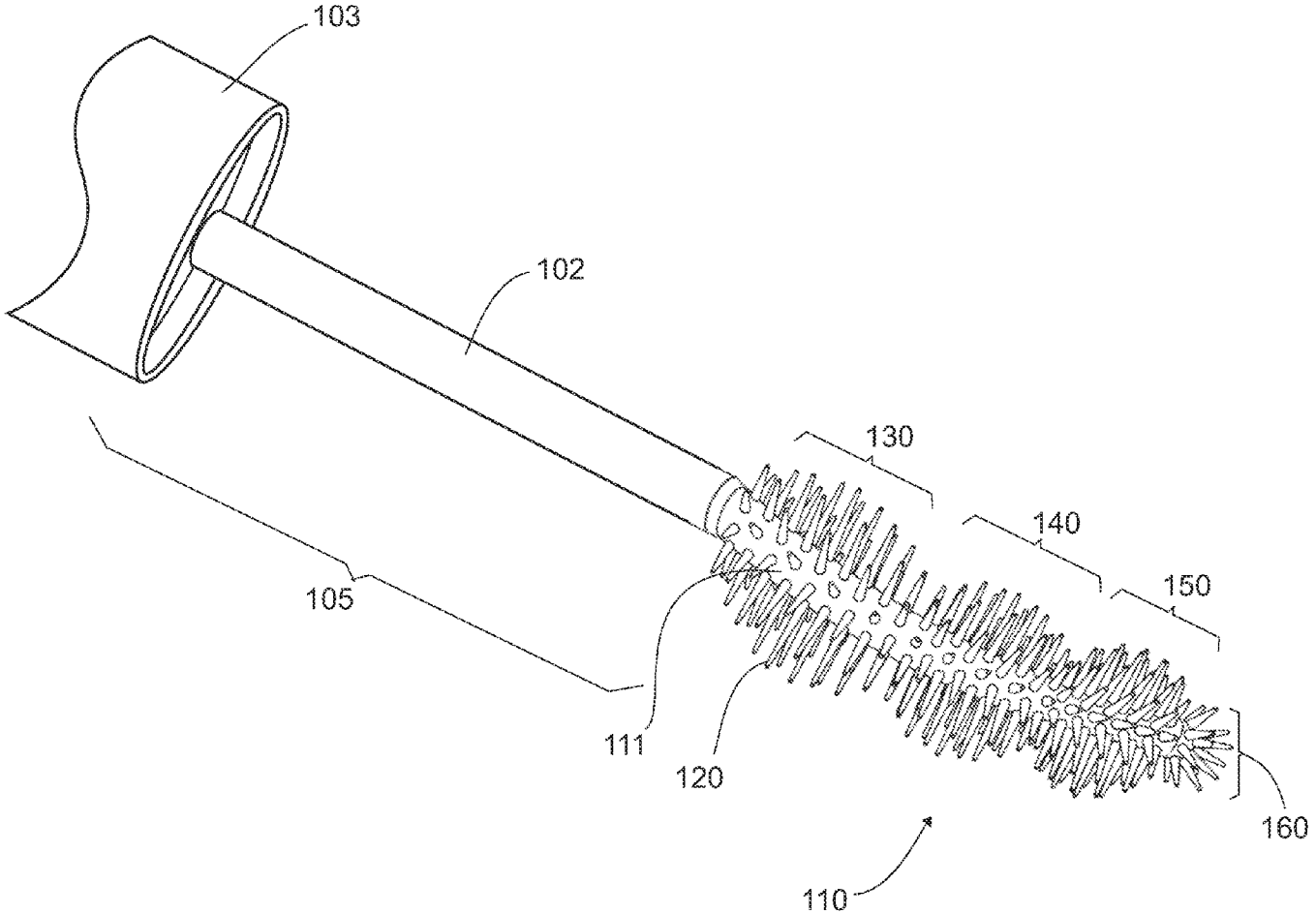
FIG. 1 shows an exemplary embodiment of an applicator according to the present invention.

Referring to FIG. 1, an exemplary mascara applicator according to the invention is shown. The applicator comprises an applicator element 110, a rod 102, and a cap 103.

The applicator element 110 comprises a cylindrical molded plastic body 111 extending from a proximal end to a distal end. As shown, the applicator element 110 comprises a plurality of bristles 120 (also sometimes referred to in the art as "tines") projecting outwardly from the body 111 such that the body is substantially covered with bristles. The body 111 and bristles 120 may be molded integrally of any suitable material, for example a plastic material, such as a thermoplastic polyester elastomer, a thermoplastic polyurethane elastomer, or compound thermoplastic materials including SBS or SEBS, in one embodiment, the body 111 and bristles 120 may be injection molded. Generally, the body 111 and bristles 120 may be manufactured according to the methods described in U.S. Pat. No. 7,325,550 to Eckers et al., incorporated by reference herein in its entirety.

The body 111 will preferably have a length of from about 20 mm to about 40 mm, more preferably from about 25 mm to about 35 mm, and most preferably about 30 mm. The width and/or diameter of the body 111 may vary along its length or may remain constant throughout. In one embodiment, the body 111 comprises a width of about 3 mm at its thickest point near the proximal end and a width of about 2 mm at its thinnest point near the distal end. However, in other embodiments, the body 111 may have a constant or varying thickness of from about 1 mm to about 4 mm.

Although shown having a slightly curved cylindrical shape, the body 111 may be of any suitable shape for applying a product to the eyelashes, such as a substantially linear shape or continuous curvilinear shape. In certain embodiments, the body 111 may have a cross-sectional shape of an enclosed curve or a polygon, for example, a circle, oval, ellipse, triangle, square, rectangle, pentagon, hexagon, octagon, star, polygon, etc. Preferably, the body 111 will be substantially rigid such that it does not bend during application. However, in certain embodiments, the body 111 may be flexible such that it may be manipulated (e.g., bent) by a user before application.

As shown, the applicator element 110, includes a plurality of bristles 120 for holding and releasing a cosmetic composition, such as mascara. Typically, each bristle 120 may be described as a projection and/or tine having a base that is wider than its tip. In certain embodiments, the bristles 120 may be fastened to the body 111 in any manner known in the art including staple set, fuse, adhesive or molding methods. The bristles 120 may comprise any suitable surface (e.g., textured or smooth) capable of holding and transferring a charge of product. Moreover, the bristles 120 may also be capable of imparting various types of aesthetically pleasing appearances to the eyelashes, such as a volumized appearance, a separated appearance (i.e., the eyelashes being individually separated from each other), a curly appearance, etc.

Bristles 120 according to one embodiment of the invention will typically be less than 10 mm in length, less than 7.5 mm in length, less than 5 mm in length, and less than 2.5 mm in length. In one embodiment, the bristles 120 are between 0.1 mm and 3 mm in length. In another embodiment, the bristles 120 comprise a diameter between about 0.2 and about 0.8 mm, as measured at the base, and typically comprise a diameter of about 0.5 mm. As discussed in detail below, the bristles 120 may be formed so that some or all of the bristles have a varying diameter, length, or cross-sectional shape. For example, some bristles 120 may have one diameter, length, and/or shape and other bristles will have another diameter, length and/or shape. Also, the cross-sectional shape or diameter of individual bristles 120 may change along their length. The bristles 120 may be, without limitation, integral with the body 111 or may be synthetic or natural fibers implanted therein.

The inventive applicator element 110 includes at least three sections (130, 140, 150) that comprise the body 111. The sections (130, 140, 150) are adapted to engage with different portions of a user's eyelashes to improve application of a cosmetic composition or to impart an aesthetically pleasing grooming effect, without the need for a user to carry and use separate devices and/or manipulate the applicator in an unnatural way. For example, an applicator element 110 may include a small 150, medium 140, and large 130 section for applying mascara to the inner, middle, and outer portion of the eyelashes, respectively. Such a device allows for improved application of a cosmetic composition, such as by a single stroke. The sections (130, 140, 150) are described in detail below with reference to FIG. 2.

In some embodiments, the applicator element includes a detailing tip 160 at its distal end. The detailing tip 160 comprises bristles 120 and may be used to reach the inner corner of the eyelashes. The detailing tip is described in detail below with reference to FIG. 3.

In some embodiments, a handle 105 is fixed to the proximal end of the applicator element 110. The handle 105 may include a cap 103 that is capable of being reversibly secured to a container of cosmetic composition and a rod 102 secured to the cap at one end thereof and secured to the applicator element 110 at the other end thereof. The handle 105 permits the user to hold and manipulate the applicator with the hand or fingers. In particular, the size and shape of the handle 105 permits the user to hold the handle between the thumb and forefingers and manipulate the applicator for application of a mascara composition to the eyelashes. Alternatively, the size and shape of the handle 105 permits the user to hold the handle within the palm of the hand and manipulate the applicator to the eyelashes for imparting a grooming effect.

Figure 2A:
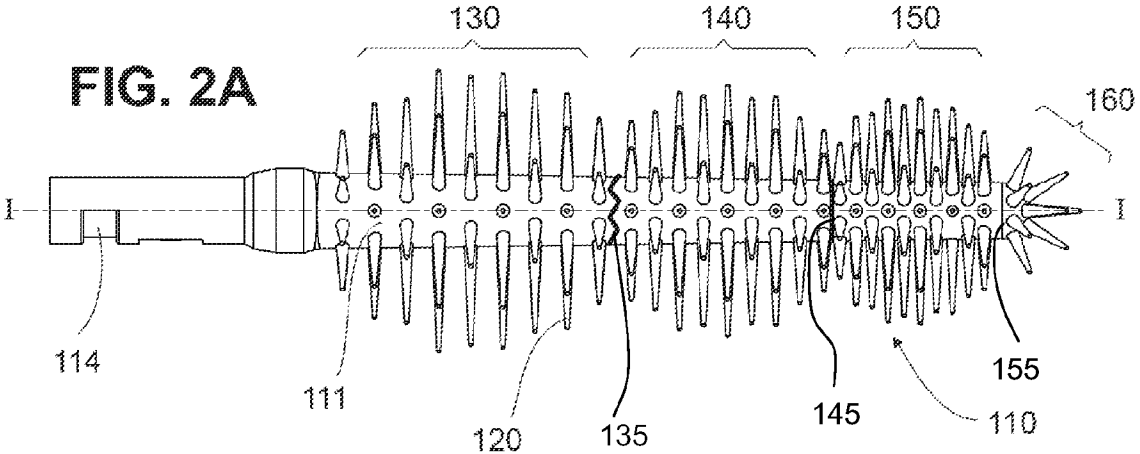
FIG. 2A shows a top view of an exemplary applicator element according to the present invention.

Referring to FIG. 2A, a top view of the applicator element 110 according to the present invention is illustrated. As shown, the applicator element 110 comprises three sections along the longitudinal axis I-I of the body 111—a large section 130, a medium section 140, and a small section 150. Each section comprises an array of bristles 120 arranged in a generally ovoid or sphere-like pattern, with shorter bristles toward the end of each section and longer bristles toward the middle each section. The density of the array (i.e., the spacing between the bristles) is varied for the sections (130, 140, 150) such that product may be evenly applied to the different portions of the eyelashes (outer, middle, inner) without clumping.

As shown, the large section 130 is adapted to engage with the longest eyelashes located towards the outside corner of the user's eye. The large section 130 comprises a plurality of bristles 120 varying in length from about 2 mm to about 5 mm. The bristles 120 are shown to increase in length towards the middle of the large section 130, and decrease in length toward the endpoints of the section, such that the section approximates a sphere-like shape. The bristles are typically spaced from about 2 mm to about 3 mm apart, and are most typically spaced about 2.5 mm apart (e.g., 2.52 mm), as measured from the tip of one bristle to the tip of an adjacent bristle. The large section 130 typically comprises a total length along the longitudinal axis I-I of the body 111 of from about 10 mm to about 15 mm, and will typically be about 12 mm. Accordingly, the large section 130 will preferably comprise from about 60 to 80 bristles, more preferably from about 65 to about 75 bristles, and most preferably about 70 bristles (e.g., 72 bristles).

The medium section 140 is adapted to engage with the medium length eyelashes in the middle of a user's eye. The medium section 140 comprises a plurality of bristles 120 varying in length from about 2 mm to about 3.5 mm. The bristles 120 are also shown to increase in length towards the middle of the medium section 140, and decrease in length toward the endpoints of the section, such that the section approximates a sphere-like shape. The bristles are typically spaced from about 1.5 mm to about 2 mm apart, and are most typically spaced about 1.9 mm apart (e.g., 1.89 mm), as measured from the tip of one bristle to the tip of an adjacent bristle. The medium section 140 typically comprises a total length along the longitudinal axis I-I of the body 111 of about 8 mm to about 10 mm, and is typically about 9 mm. Accordingly, the medium section 140 will preferably comprise from about 60 to 80 bristles, more preferably from about 65 to about 75 bristles, and most preferably about 70 bristles (e.g., 73 bristles).

The small section 150 is adapted to engage with the shortest eyelashes located towards the inner corner of a user's eye. The small section 150 comprises a plurality of bristles 120 varying in length from about 2 mm to about 3 mm. The bristles 120 are also shown to increase in length towards the middle of the small section 150, and decrease in length toward the endpoints of the section, such that the section approximates a sphere-like shape. The bristles are typically spaced from about 1 mm to about 1.5 mm apart, and are most typically spaced about 1.3 mm apart (e.g., 1.26 mm), as measured from the tip of one bristle to the tip of an adjacent bristle. The small section 150 typically comprises a total length along the longitudinal axis I-I of the body 111 of about 5 mm to about 8 mm, is most typically about 6 mm. Accordingly, the small section 150 will preferably comprise from about 70 to 90 bristles, more preferably from about 75 to about 85 bristles, and most preferably about 80 bristles.

In one embodiment, the three sections (130, 140, 150) and/or the detailing tip 160 may be removably attached to one another, such as by a snap-fit or complimentary threading. For example, the distal end of the large section 130 may comprise threading 135 that engages with threading on the proximal end of the medium section 140. As another example, the distal end of the medium section 140 may comprise a snap-fit 145 that engages with a snap fit of the proximal end of the small section 150. In yet another example, the distal end of the small section 150 may comprise threading 155 that engages with the complimentary threading on the proximal end of a distal tip 160. In this way, a user may store the applicator in an unassembled state or may customize an applicator to include any number of small 150, medium 140, and/or large 130 sections, with or without a detailing tip 160.

The applicator element 110 is shown to comprise a snap-fit 114 at its proximal end, which engages with a rod of a handle (not shown) such that the applicator element 110 may be easily manipulated by a user to apply a composition to the eyelashes. Although shown as a snap-fit 114, the applicator element may be attached to a rod by any other means known in the art, such as but not limited to, complimentary screw threads and the like.

Figure 2B:
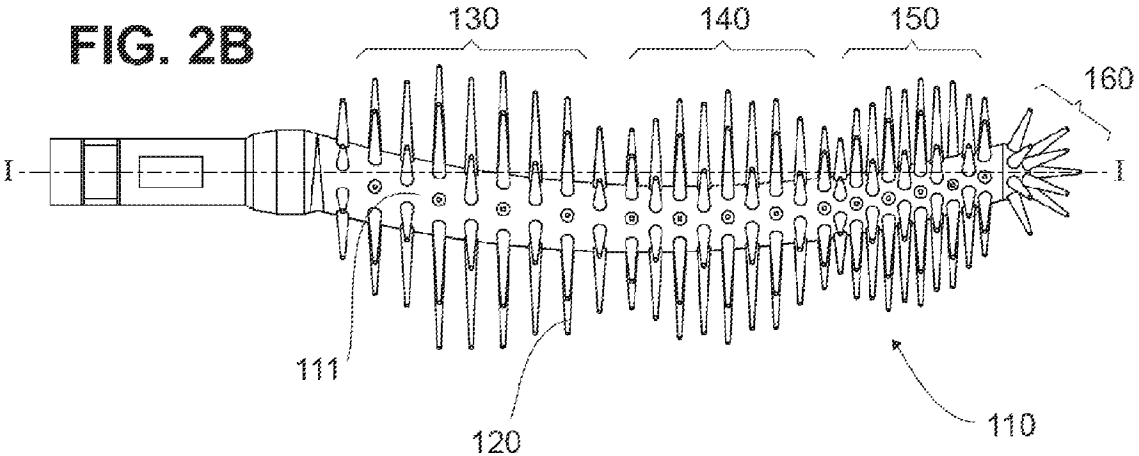
FIG. 2B shows a side view of an exemplary applicator element according to the present invention.

Referring to FIG. 2B, a side view of the applicator element 110 illustrated. As shown, the body of the applicator element is preferably curved about an axis I-I to match the natural shape of eyelashes, such that the small 150, medium 140, and large 130 sections may better engage with the inner, middle, and outer portions of the eyelashes, respectively. Accordingly, the body 111 of the applicator element 110 may be curved such that the radius of the curve is from about 40 mm to about 60 mm, and preferably about 50 mm. As discussed above, the body 111, although typically rigid, may be made to be flexible such that a user can bend or manipulate the body to a desired curvature.

Figure 3:
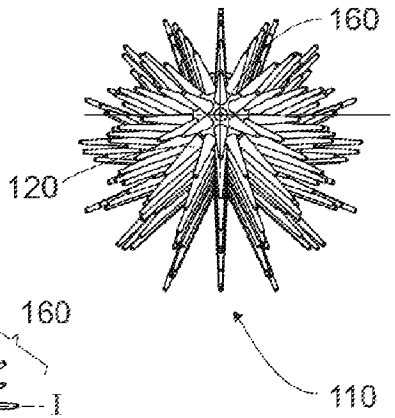
FIG. 3 shows a front view of an exemplary applicator element according to the present invention.

Referring to FIG. 3, a front view of an exemplary applicator is illustrated, wherein the applicator comprises an optional detailing tip 160, which may be used to apply a product to the most inner corner of a user's eye. The detailing tip 160 comprises from about 10 to about 20 bristles 120, and preferably about 15 bristles. As shown, one or more of the bristles 120 may be implanted parallel or near parallel to the plane of the applicator. The one or more bristles 120 may vary in length and position, but will typically comprise a length of from about 0.5 mm to about 5 mm, more typically from about 1 mm to about 3 mm, and most typically about 2 mm.

In one embodiment, the detailing tip 160 may be manufactured as an integral piece of the applicator element 110. However, in other embodiments, the detailing tip 160 may be a separate piece that may be permanently fixed to the distal end of the applicator element 110 or may be removable and/or interchangeable. It will be appreciated that the detailing tip 160 is optional, and the distal end of the applicator may simply comprise a flat or round surface without bristles 120.

Figures 4A, 4B, 4C:
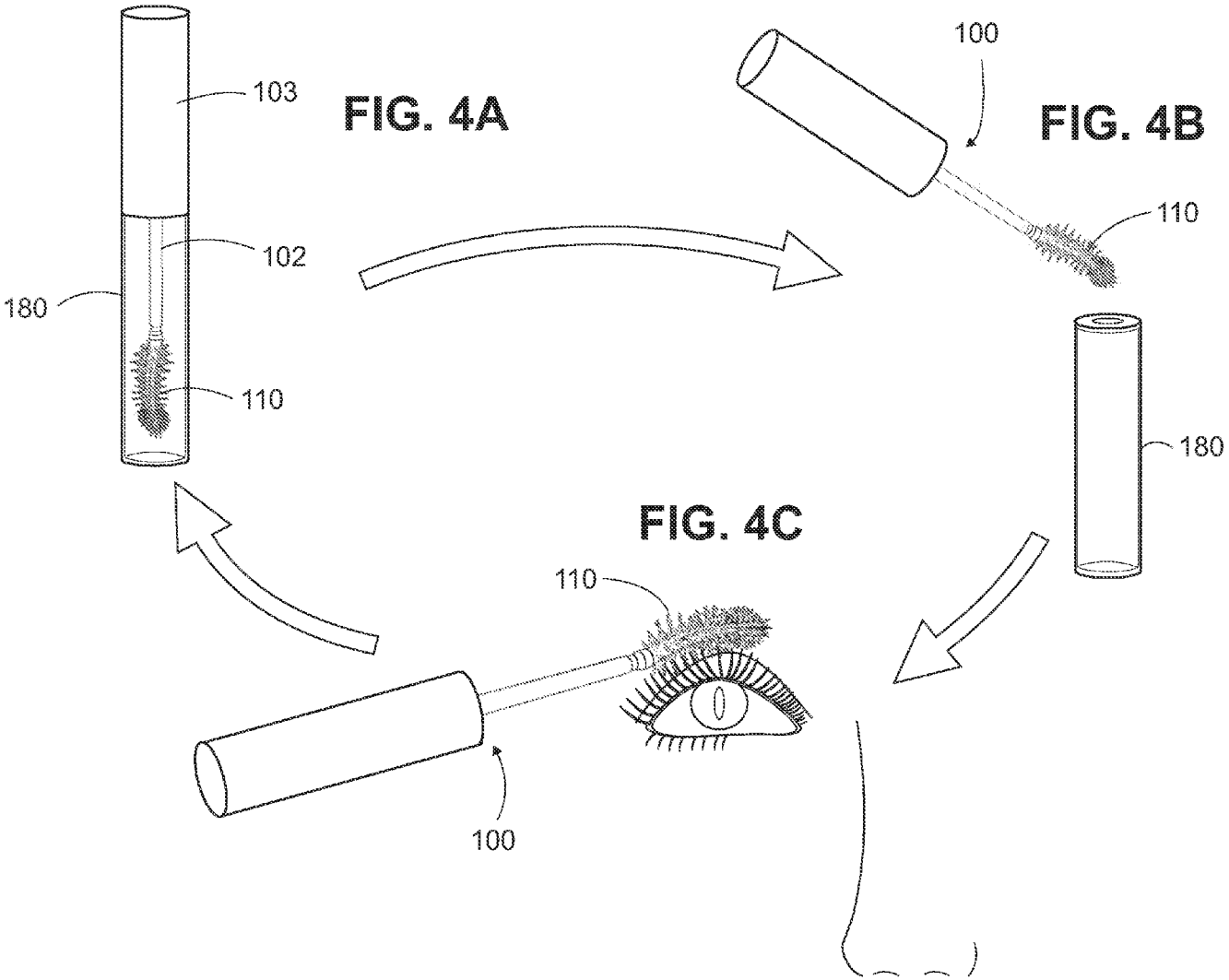
FIGS. 4A-4C show a process diagram for the application of a material, from within a container (FIG. 4A), withdrawal from the container (FIG. 4B), to application to eyelashes (FIG. 4C), according to an exemplary embodiment.

Referring to FIGS. 4A through 4C, an exemplary process diagram is illustrated. As shown, the applicator element 110 is attached to a handle, which encompasses a cap 103 capable of being reversibly secured to a container 180 and a rod 102 secured to the cap at a proximal end thereof and secured to the applicator element at the other end thereof.

The particular shape of the rod 102 is not important, but the rod may have an elongated shape and may have a solid or hollow interior. For example, the rod 102 may be in the shape of a solid elongated cylinder, a hollow elongated cylinder comprising a cylindrical space therein concentric with a longitudinal axis of the rod, or the rod may have an irregular cross section, a U-shaped cross section, or the like. Other suitable shapes for the rod may include solid or hollow elongated shapes having a cross sectional shape of an enclosed curve or a polygon, for example, a circle, oval, ellipse, triangle, square, rectangle, pentagon, hexagon, octagon, star polygon, etc. In addition, the rod may be made of any suitable material such that the rod is flexible, semi-flexible, rigid, or semi-rigid.

The cap 103 is preferably sized to fit over a portion of the container 180 and is capable of reversibly engaging a neck portion of the container using any suitable reversible connector mechanism. In a preferred embodiment, the neck portion of the container 180 and the cap 103 have complementary threads. In another embodiment, the neck portion of the container 180 may include a notch and the cap 103 may include a corresponding depression for engaging the notch.

Preferably a kit, including the applicator element 110, the rod 102, the cap 103 and the container 180, may be made from plastic, metal, and/or thermoplastic elastomers, manufactured using injection and/or injection blow molding, and assembled by snap-fit assembly. However, it is contemplated that any other material, manufacturing, and/or assembly method may also be used. In particular, the cap 103 and the container 180 may be made with anodized plastic materials to provide a metallic look.

The container 180 may also include at least one wiper for removing excess product from the applicator element 110. The applicator element 110 may be used in combination with the container 180 by first placing the applicator into the container so as to bring the applicator element into contact with the product.

As shown in FIG. 4B, the applicator 100 is withdrawn from the container 180 to meter a charge of the product (e.g., cosmetic composition such as mascara) onto the applicator. While the applicator 100 is being withdrawn from the container 180, the wiper removes excess product from the applicator element 110 by a smoothing motion and pushes the excess product back into the container.

The wiper may be attached to or is an integral part of an interior or an exterior surface of the container 180 and is capable of removing excess cosmetic composition from the large portion, medium portion, and/or the small portion of the applicator element 110. In some embodiments, the wiper may be attached to or is an integral part of an opening of the container 180. Preferably, the wiper is attached to the neck of the container 180.

It is contemplated that the wiper may have any suitable size and/or shape. Preferably, the wiper is suitably sized and/or shaped to be capable of removing excess cosmetic composition from the small, medium, and/or large portion of the applicator element 110 with a single motion when the applicator 100 is removed from the container 180. In one embodiment, the wiper has a shape that generally matches the cross-section of the applicator element 110.

Referring to FIG. 4C, once the applicator 110 is impregnated with product, the applicator 100 may be used to apply the material to a desired structure or surface. In the case of mascara, a charged applicator element 110 may be used to apply the mascara to a user's eyelashes. As shown, the user may align the applicator element 110 with the entire width of the eyelash span. By contacting the eyelashes with the applicator element 110, the mascara may be transferred from the applicator element to the eyelashes. For example, the user may position the applicator element 110 onto the eyelashes such that the applicator element is placed into contact with the roots of the eyelashes. The user may then pull the applicator element 110 along the eyelashes, towards the tips thereof, forcing the eyelashes to interact with applicator. Due to the novel shape of the applicator element 110, this simplified action provides efficient yet comprehensive coverage and allows the user to apply an even and consistent coat of the mascara on the entirety of the eyelashes (e.g., inner, middle, and outer portion of the eyelashes).

The invention described and claimed herein is not to be limited in scope by the specific embodiments herein disclosed since these embodiments are intended as illustrations of several aspects of this invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All publications cited herein are incorporated by reference in their entirety.

What is claimed is:

1. An applicator for applying a product to the eyelashes comprising:

a handle attached directly or indirectly to the proximal end of an applicator element, the applicator element having a generally elongated body comprising, in series, from the proximal end to its distal end, a first section, a second section, and a third section, each of said sections comprising a plurality of rows of bristles extending radially from said body, wherein the bristles vary in length in different rows, wherein longest bristles in each section are located toward the middle of that section to give each section a generally ovoid or spherical appearance; wherein the spacing between adjacent bristles within each section having said generally ovoid or spherical appearance differs from one section to another, and is largest in said first section and smallest in said third section wherein the longest bristles in each section differ in length from the longest bristles in each other section.

2. The applicator of claim 1, wherein the lengths of the bristles within each section vary to give said generally ovoid or spherical appearance to each section.

3. The applicator of claim 1, wherein said handle is connected to the proximal end of said applicator element by an elongated rod.

4. The applicator of claim 1, wherein adjacent bristles of the first section are separated by from about 2 to about 3 mm.

5. The applicator of claim 1, wherein adjacent bristles of the second section are separated by from about 1.5 to about 2 mm.

6. The applicator of claim 1, wherein adjacent bristles of the third section are separated by from about 1 to about 1.5 mm.

7. The applicator of claim 1, wherein adjacent bristles of the first section are separated by from about 2 to about 3 mm; adjacent bristles of the second section are separated by from about 1.5 to about 2 mm; and adjacent bristles of the third section are separated by from about 1 to about 1.5 mm.

8. The applicator of claim 1, wherein the longest bristle of the first section is longer than the longest bristle of the second section, and the longest bristle of the second section is longer than the longest bristle of the third section.

9. The applicator of claim 1, wherein the bristles of the first, second, and third sections comprise a diameter of about 0.5 mm.

10. The applicator of claim 1, wherein the body is curved.

11. The applicator of claim 1, wherein the body, including the first, second, and third sections are molded plastic.

12. The applicator of claim 1, wherein the second section is removably attached to the first section, and the third section is removably attached to the second section.

13. The applicator element according to claim 1, wherein the first section includes from about 60 to about 80 bristles, the second section includes from about 60 to 80 bristles, and the third section includes from about 70 to 90 bristles.

14. The applicator according to claim 1 further comprising a detailing tip at the distal end of the body.

15. The applicator according to claim 14, wherein the detailing tip comprises one or more bristles extending parallel to an axis extending from the distal end of the body.

16. The applicator according to claim 15, wherein the detailing tip is removably attached to the distal end of the third section.

* * * * *